US008851191B2

(12) United States Patent
Mhaskar et al.

(10) Patent No.: US 8,851,191 B2
(45) Date of Patent: Oct. 7, 2014

(54) SELECTIVELY FIRED HIGH PRESSURE HIGH TEMPERATURE BACK-OFF TOOL

(75) Inventors: Nauman H. Mhaskar, Cypress, TX (US); William B. Harvey, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 427 days.

(21) Appl. No.: 13/276,093

(22) Filed: Oct. 18, 2011

(65) Prior Publication Data

US 2013/0092378 A1 Apr. 18, 2013

(51) Int. Cl.
*E21B 29/02* (2006.01)
*E21B 31/16* (2006.01)

(52) U.S. Cl.
CPC ..... *E21B 29/02* (2013.01); *E21B 31/16* (2013.01)
USPC ..... 166/377; 166/178; 166/299

(58) Field of Classification Search
CPC ..... E21B 29/02; E21B 31/1075
USPC ..... 166/301, 377, 63, 178, 299
See application file for complete search history.

(56) References Cited

U.S. PATENT DOCUMENTS

| | | | | |
|---|---|---|---|---|
| 4,253,523 | A | 3/1981 | Ibsen | |
| 4,391,337 | A | 7/1983 | Ford | |
| 4,537,255 | A | 8/1985 | Regalbuto et al. | |
| 5,007,344 | A * | 4/1991 | Ricles et al. | 102/312 |
| 5,355,802 | A | 10/1994 | Petitjean | |
| 5,477,785 | A * | 12/1995 | Dieman et al. | 102/313 |
| 5,775,426 | A | 7/1998 | Snider et al. | |
| 6,082,450 | A | 7/2000 | Snider et al. | |
| 6,755,249 | B2 | 6/2004 | Robison et al. | |
| 6,991,044 | B2 | 1/2006 | Zhang et al. | |
| 7,044,225 | B2 | 5/2006 | Haney | |
| 7,059,411 | B2 | 6/2006 | Hayes | |
| 7,431,075 | B2 | 10/2008 | Brooks et al. | |
| 7,565,930 | B2 | 7/2009 | Seekford | |
| 2008/0053658 | A1 | 3/2008 | Wesson | |
| 2008/0115943 | A1 | 5/2008 | Myers et al. | |
| 2008/0164030 | A1 * | 7/2008 | Young | 166/299 |
| 2009/0242198 | A1 | 10/2009 | Evans et al. | |

OTHER PUBLICATIONS

Core Laboratories, "Products: More Stim Gun Tube," Jun. 9, 2011, found at www.corelab.com/pe/owen/products_morestimguntube.aspx.

Core Laboratories, "Stimgun & Stimtube Assembly Enhanced Stimulation Operations," Jun. 9, 2011, found at www.corelab.com/pe/owen/products.aspx?type=stimgun.

* cited by examiner

*Primary Examiner* — Cathleen Hutchins
(74) *Attorney, Agent, or Firm* — Bracewell & Giuliani LLP

(57) ABSTRACT

A method for unseating a threaded connection of wellbore tubing within the wellbore. The method utilizes a back-off tool which consists of a tubular metal housing, a shaped charge and HNS detonating cord within the housing, and an explosive material attached to the housing. The back-off tool is detonated near the threaded connection, creating a shock-wave that strikes the threaded connection with sufficient force to unseat the connection.

13 Claims, 4 Drawing Sheets

33
35
32
34
20
36

SELECTIVELY FIRED HIGH PRESSURE HIGH TEMPERATURE BACK-OFF TOOL

BACKGROUND

1. Field of Invention

The present invention relates to oil and gas production. More specifically, the present invention relates to a tool that creates a shockwave in a wellbore to "back-off" threads engaged in a threaded couplings within a tubular string.

2. Description of Prior Art

Typically, tubulars are connected together by threaded couplings to form a string that is suspended and cemented in a wellbore to create a casing for the wellbore. From time to time, the casing string may need to be removed from the wellbore and the threaded couplings are decoupled at surface. In some instances while removing the casing it may become wedged within the wellbore; further complicating string removal, while still downhole, one of the threaded couplings may resist detachment under an applied torque to become immovable. The immovable coupling is sometimes unseated by directing a shockwave at the coupling site to break loose the threaded connection.

A typical prior art tool used to create this shockwave consists of multiple strands of detonator cord wrapped around a shot rod in a rope-like fashion and wrapped with friction tape. Generally this tool employs a detonation cord having HMX (octahydro-1,3,5,7-tetranitro-1,3,5,7-tetrazocine), which can withstand operating temperatures of 400 degrees Fahrenheit for only about an hour. While a detonating cord having HNS (1,3,5-Trinitro-2-[2-(2,4,6-trinitrophenyl)ethenyl]benzene) can operate at temperatures above those limiting use of HMX detonator cord, HNS detonating cord cannot side detonate and thus is not utilized in the above described prior art tool. Also, operating pressure of typical prior art is limited to 20,000 psi due to the use of exposed (to wellbore fluids) interface between detonator and detonating cord.

SUMMARY OF THE INVENTION

The present disclosure involves a method of unseating a threaded connection that connects sections of wellbore tubing. In an example the method uses a tool that includes a housing, a shaped charged located inside the housing, an HNS detonating cord and an energetic material attached to the steel housing. The tool is placed near the threaded connection, where it is detonated, creating a shockwave that contacts the threaded connection with sufficient force to unseat the threaded connection.

Also disclosed is a method of an operation in a wellbore that includes inserting an amount of reactive material within a string of wellbore tubular segments, where a threaded connection joins upper and lower adjacent tubular segments. A shockwave is generated by initiating the reactive material that unseats the threaded connection by directing the shockwave towards the threaded connection. The upper tubular segment is rotated thereby eliminating the threaded connection and the upper tubular segment is removed from the wellbore. In an example, the reactive material is initiated by a jet from a shaped charge that terminates proximate an outer surface of the reactive material. In one alternative embodiment, the reactive material includes a high explosive, wherein initiating the high explosive causes the high explosive to detonate. Optionally, the reactive material is a low explosive, wherein initiating the low explosive causes the low explosive to deflagrate. In another alternative, the reactive material includes a combustible material, wherein initiating the combustible material causes the combustible material to combust. Alternatively, initiating the reactive material includes using a detonation cord having HNS to detonate a shaped charge thereby forming a jet, and directing the jet at the reactive material. The pressure can be at least about 30,000 pounds per square inch within the string of tubular segments. At least a portion of the HNS detonating cord can be maintained at a temperature of at least about 480° F. and for a time up to about 1 hour.

Also disclosed herein is an embodiment of a back off tool for use in a downhole tubular. In one example the back off tool includes a body selectively suspended in the downhole tubular by attachment to a deployment member. A reactive material is included adjacent the body for generating a shockwave to unseat an immovable threaded connection between adjacent tubular segments. An initiator is provided in selective communication with the deployment member and in selective initiating communication with the reactive material. In one example, the initiator is a shaped charge that forms a jet to initiate a reaction in the reactive material. Alternatively, a detonating cord having HNS can be included with the back off tool. In an example embodiment, the body and the reactive material each include an axis, and the reactive material is disposed adjacent an end of the body and positioned so that the axis of the reactive material is substantially parallel with the axis of the body. Alternatively, the reactive material can be a high explosive.

BRIEF DESCRIPTION OF DRAWINGS

Some of the features and benefits of the present invention having been stated, others will become apparent as the description proceeds when taken in conjunction with the accompanying drawings, in which.

Figure 1:
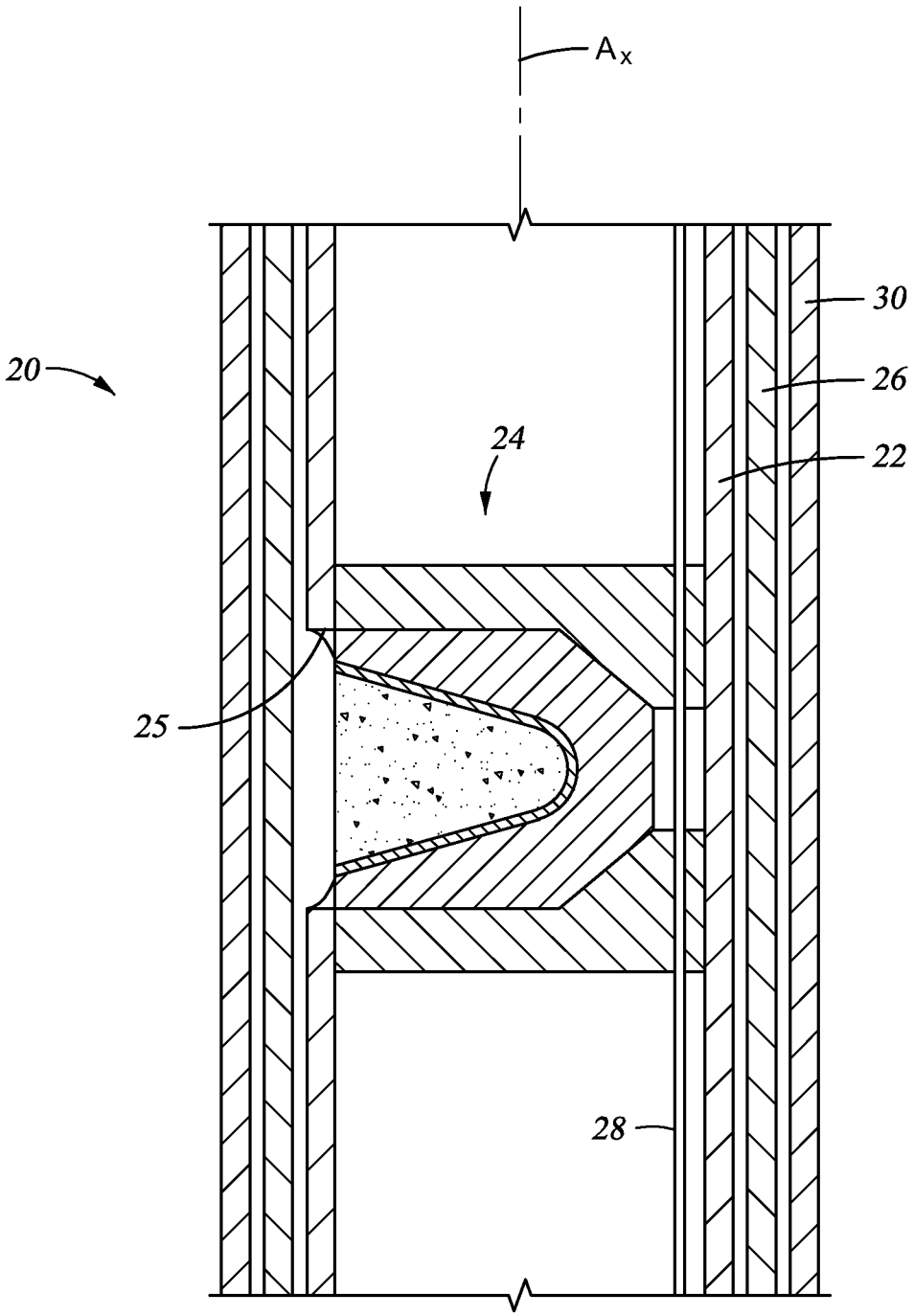
FIG. 1 is a side sectional view of an embodiment of a back-off tool in accordance with the present disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

FIG. 1 depicts, in a cross-sectional view, an embodiment of a portion of a back off tool 20 that can be used in high pressure and high temperature applications. In the example of FIG. 1, the back off tool 20 includes an annular gun tube 22 shown containing a shaped charge 24 and oriented orthogonal to an axis $A_X$ of the gun tube 22. The shaped charge 24 is shown having an open end set within an opening 25 formed through a side wall of the gun tube 22. In the example of FIG. 1, the gun tube 22 is enclosed in a tubular housing 26 that, in an example embodiment, may be formed from steel. A detonating cord 28 is further included with the embodiment of the back off tool 20 of FIG. 1. The detonating cord 28, which in an example embodiment may be an HNS detonating cord, is shown extending along the gun tube 22 and routed so that its path runs adjacent an end of the shaped charge 24. A sleeve 30 is shown encasing the outer surface of the tubular housing 26. The sleeve 30 may be formed from an energetic material that when initiated reacts and generates a shockwave. Materials for the sleeve 30 can include any material capable of generating a shockwave, examples include an oxidizer, a propellant, a high explosive, e.g. HMX, RMX, HNS, a low explosive, a combustible material, and combinations thereof.

The material for the sleeve 30 can detonate, deflagrate, combust, or a combination thereof. In an example, the definition of detonation describes a reaction that can propagate through the material being detonated at the sound speed of the material. In a further example, detonation describes a reaction or decomposition of an explosive that, typically in response to a shock wave or heat, forms a high pressure/temperature wave. Example velocities of the high pressure/temperature wave can range from 1000 m/s to in excess of 9000 m/s. In an example, the definition of deflagration describes a rapid autocombustion of a material, such as an explosive. Generally, explosives that detonate are referred to as high explosives and explosives that deflagrate are referred to as low explosives. In an example, combustion describes an exothermic reaction of a material that can produce an oxide.

Figure 2:
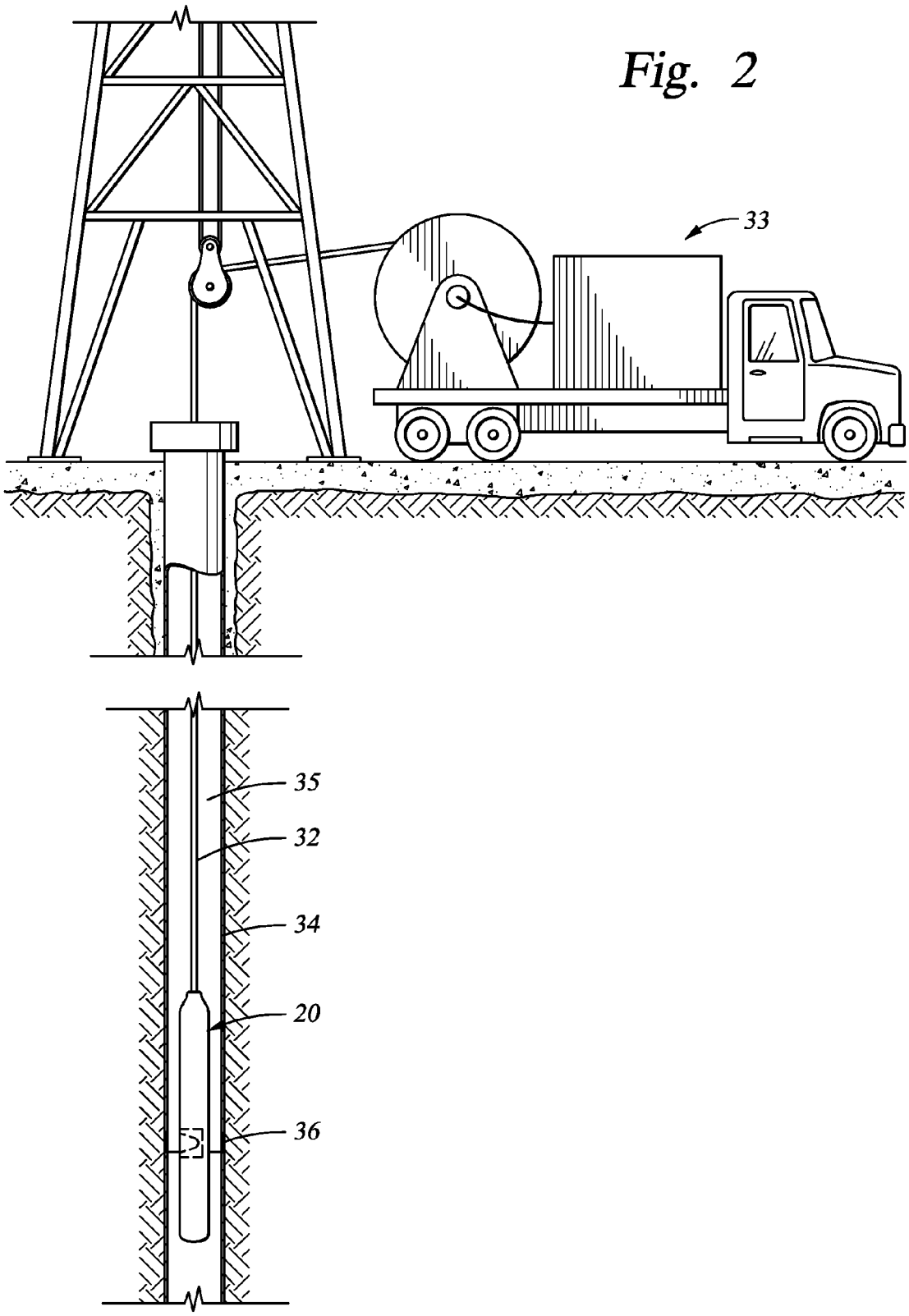
FIG. 2 is a partial cutaway side view of a back-off operation.
Figure 3:
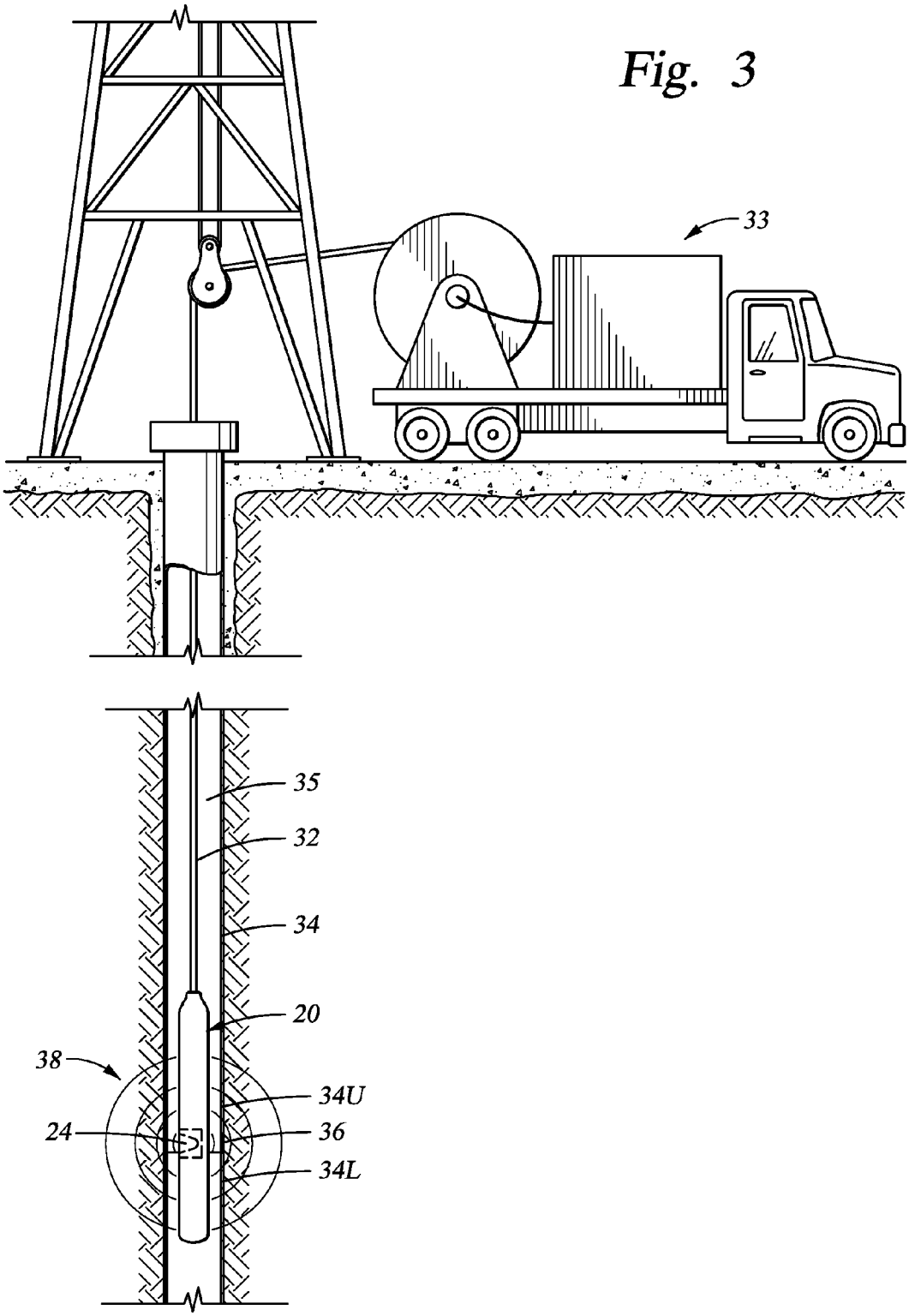
FIG. 3 is a partial cutaway side view of a shockwave striking the threaded coupling.
Figure 4:
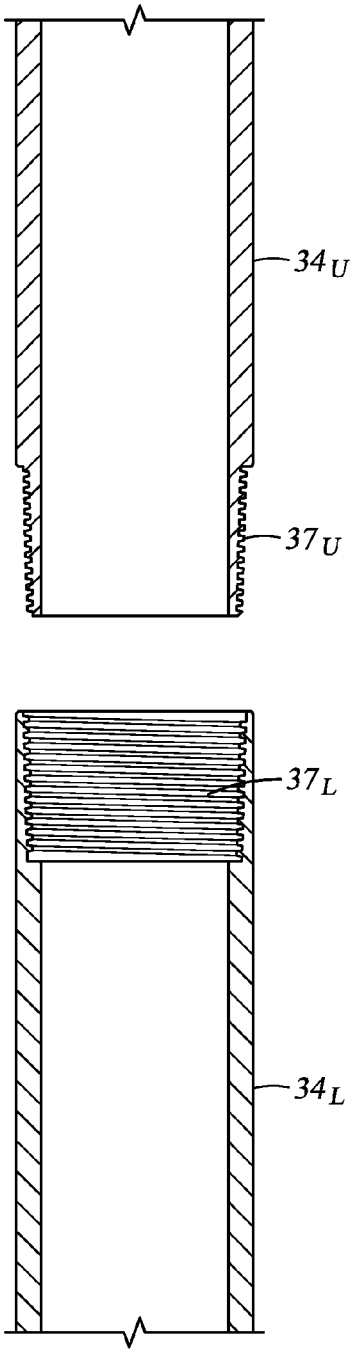
FIG. 4 is a partial cutaway side view of a wellbore as the upper casing section is removed.

In one example of operation, and as provided in FIGS. 2-4, a detonation wave is initiated in the detonating cord 28 that transfers a shock wave to and detonates the shaped charge 24. As will be discussed in further detail below, in one example embodiment of the back off tool 20, a jet (not shown) formed from detonation of the shaped charge 24 penetrates the housing 26 and the sleeve 30 reacting the sleeve 30, which provides the necessary shockwave for the back-off operation. In an example embodiment, the jet does not extend past the sleeve 30, or extends slightly past.

Referring now to FIG. 2, shown in a side sectional view is an embodiment of the back off tool 20. In the embodiment of FIG. 2, the back off tool 20 is suspended by a wireline 32 shown being reeled from and controlled by a surface truck 33. Alternatively, the wireline 32 can be threaded through a wellhead assembly (not shown) disposed on the surface. The back off tool 20 and wireline 32 are inserted within a string of wellbore casing 34 that line a wellbore 35. The casing string is made up of segments of casing 34, each segment having threaded ends that threadingly couple together to form a threaded connection 36. More specifically in the example of FIG. 2, the back off tool 20 is suspended adjacent a threaded connection 36 that is immovable. For the purposes of discussion herein, and as described above, a threaded connection 36 that is immovable describes a threaded connection 36 that resists decoupling.

In the example embodiment of FIG. 3 shown in side partial sectional view is an example embodiment where the shaped charge 24 in the back off tool 20 has been detonated that in turn initiates detonation of the sleeve 30. When the sleeve 30 is detonated it creates a shockwave 38 that propagates through the threaded connection 36, as shown in FIG. 3. The force of the shockwave 38 can remove stresses in the threaded connection 36 joining upper and lower segments of casing $\mathbf{34}_U$, $\mathbf{34}_L$ thereby allowing the threaded connection 36 to back-off as torque is applied to the upper segment of casing $\mathbf{34}_U$. Thus continued application of torque to the upper segment casing $\mathbf{34}_U$ rotates the upper segment of casing $\mathbf{34}_U$ decoupling upper and lower threads $\mathbf{37}_U$, $\mathbf{37}_L$ to eliminate the threaded connection 36 that couples the upper and lower segments of casing $\mathbf{34}_U$, $\mathbf{34}_L$. As shown in side sectional view in FIG. 4, once decoupled, the upper segment of casing $\mathbf{34}_U$ can be detached from the lower segment of casing $\mathbf{34}_L$ and removed from the wellbore 35. In an optional embodiment, the back off tool 20 includes more than one sleeve 30 so that a shock wave can be generated at a first depth, the back off tool 20 raised or lowered to a second depth, and another shock wave generated by initiating the more than one sleeve.

Figure 5:
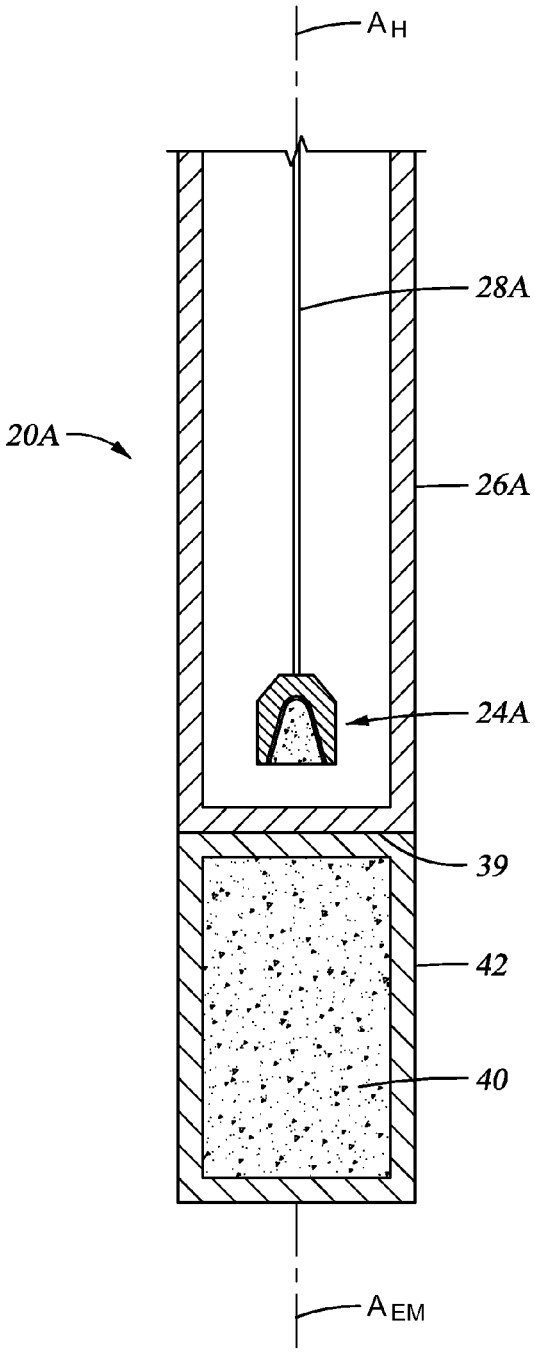
FIG. 5 depicts in a side sectional view an alternate embodiment of a back-off tool in accordance with the present disclosure.

An alternate embodiment of a portion of a back off tool 20A is shown in a side sectional view in FIG. 5. The back off tool 20A of FIG. 5 includes a shaped charge 24A suspended from a length of detonating cord 28A shown disposed inside a generally cylindrically shaped housing 26A. Disposed adjacent to a lower end 39 of the housing 26A is a substantially cylindrically shaped amount of reactive material 40 oriented generally coaxial with the housing 26A. In an example embodiment, the reactive material 40 includes the same or similar material of the sleeve 30 as described above. The shaped charge 24A of FIG. 5 is oriented so that when detonated any jet resulting from the shaped charge 24A is directed towards the lower end 39 and reactive material 40, rather than a side radial wall as illustrated in the example of FIG. 1. In the example embodiment of FIG. 5, an axis $A_H$ of the housing 26A is shown to be substantially coaxial with an $A_{EM}$ of the reactive material 40. Embodiments exist as well where the axes $A_H$, $A_{EM}$ are substantially parallel. Optionally, the reactive material 40 may be encased in a jacket 42 for protecting the reactive material 40 during the trip downhole. Operation of the back off tool 20A of FIG. 5 is similar to the operation described above; that is, the back off tool 20A is inserted into a tubular string and the reactive material 40 is reacted, such as by detonating the shaped charge 24A. An ensuing shock wave, not shown, transfers energy to an immovable threaded connection so that the connection can be decoupled.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the back off tool 20 and its alternate embodiments can be disposed in other downhole tubulars, such as production tubing strings, caissons, risers, and the like. These and other similar modifications will readily suggest themselves to those skilled in the art, and are intended to be encompassed within the spirit of the present invention disclosed herein and the scope of the appended claims.

What is claimed is:

1. A method of an operation in a wellbore comprising:

a. providing a tubular housing and an amount of reactive material on an outer surface of the tubular housing;

b. inserting the housing within a string of tubular segments that are disposed in a wellbore and have a threaded connection joining upper and lower adjacent tubular segments, and so that the amount of reactive material is in an annular space between the housing and the string of tubular segments;

c. generating a shockwave by initiating the reactive material;

d. unseating the threaded connection by directing the shockwave towards the threaded connection;

e. rotating the upper tubular segment to remove the threaded connection; and f. removing the upper tubular segment from the wellbore.

2. The method of claim 1, wherein the reactive material is initiated by a jet from a shaped charge that terminates proximate an outer surface of the reactive material.

3. The method of claim 1, wherein the reactive material comprises a high explosive and wherein initiating the high explosive causes the high explosive to detonate.

4. The method of claim 1, wherein the reactive material comprises a low explosive and wherein initiating the low explosive causes the low explosive to deflagrate.

5. The method of claim 1, wherein the reactive material comprises a combustible material and wherein initiating the combustible material causes the combustible material to combust.

6. The method of claim 1, wherein the step of initiating the reactive material comprises using a detonation cord having hexanitrostilbene to detonate a shaped charge thereby forming a jet, and directing the jet at the reactive material.

7. The method of claim 6, wherein pressure within the string of tubular segments is at least about 30,000 pounds per square inch.

8. The method of claim 6, wherein at least a portion of the detonating cord is maintained at a temperature of at least about 480° F. and for a time up to about 1 hour.

9. A back off tool for use in a downhole tubular comprising:

a body selectively suspended in the downhole tubular by attachment to a deployment member;

a sleeve of reactive material circumscribing the body for generating a shockwave that unseats an immovable threaded connection between adjacent tubular segments; and an initiator in selective communication with the deployment member and in selective initiating communication with the reactive material.

10. The back off tool of claim 9, wherein the initiator comprises a shaped charge that selectively forms a jet to initiate a reaction in the reactive material.

11. The back off tool of claim 10, further comprising a detonating cord comprising hexanitrostilbene.

12. The back off tool of claim 10, wherein the body and the reactive material each include an axis, and the reactive material is disposed adjacent an end of the body and positioned so that the axis of the reactive material is substantially parallel with the axis of the body.

13. The back off tool of claim 9, wherein the reactive material comprises a high explosive.

* * * * *